United States Patent [19]

Manganaro

[11] 3,950,721

[45] Apr. 13, 1976

[54] NESTED BOBBINS FOR AN ELECTRO-MAGNETIC STAPLING MACHINE

[75] Inventor: George F. Manganaro, Lake Hiawatha, N.J.

[73] Assignee: Electro-Matic Staplers Inc., Saddle Brook, N.J.

[22] Filed: Sept. 11, 1974

[21] Appl. No.: 505,169

[52] U.S. Cl. ..... 335/278; 336/208

[51] Int. Cl.[2] ..... H01F 7/00

[58] Field of Search ..... 336/198, 208; 335/255, 335/257, 258, 260, 261, 278, 279, 282

[56] References Cited

UNITED STATES PATENTS

| | | | |
|---|---|---|---|
| 2,225,593 | 12/1940 | McArn | 336/208 X |
| 2,783,340 | 2/1957 | Davies et al. | 335/261 X |
| 3,168,242 | 2/1965 | Diener | 335/261 X |
| 3,400,351 | 9/1968 | Flentge | 335/257 |
| 3,505,628 | 4/1970 | Allen | 335/255 |

*Primary Examiner*—George Harris
*Attorney, Agent, or Firm*—J. B. Felshin

[57] ABSTRACT

This stapling machine has mechanical means to block the path of the staple plunger to prevent a staple driving operation unless the stapler is on a work piece in position to drive the staples into the work piece. The magnetic coil comprises a pair of inner and outer bobbins of high heat resisting, electric insulating material, with a barrier bobbin in between said pair of bobbins, to keep whatever might break down one of said pair of bobbins from breaking down the other of said pair of bobbins, to thereby protect electrical components of the electro-magnetic stapler. The lower end of the armature controlled by the electro-magnetic coil of the stapler, has a conical cavity at its lower end movable to a position receiving but not contacting a conical core at the lower end of the coil, to give extra power to the armature because of greater magnetic surface between the armature and core and yet preventing actual thrust contact blows between the armature and core, which might damage the stapler machine.

11 Claims, 10 Drawing Figures

NESTED BOBBINS FOR AN ELECTRO-MAGNETIC STAPLING MACHINE

This invention relates to electro-magnetic stapling machines.

One object of the invention is to generally improve the electro-magnetic stapler disclosed in U.S. Pat. No. 3,786,978 granted Jan. 22, 1974.

Said U.S. Pat. No. 3,786,978 discloses a safety switch controlled by work engaging means on the stapler to prevent operation of the stapler unless said work engaging means contacts the work piece. In the present stapling machine, said switch is replaced by mechanical blocking means normally in the path of the staple driving plunger, to prevent the plunger from driving a staple, and means controlled by work piece engaging means on the machine, which contacts the work piece and moves the blocking means out of the path of the plunger, to allow trigger controlled electro-magnetic means to actuate the plunger to drive a staple. This safety feature hence does not depend wholly on electric controlled switch means for the safe use of the machine.

Another object of this invention is to provide in a stapling machine of the character described, an electro-magnetic coil comprising a bobbin assembly for the coil wire, comprising a pair of inner and outer nested bobbins of high heat resisting, electric insulating material, with a barrier bobbin in between, so that if one of said pair of bobbins breaks down, the barrier bobbin will protect the remaining one of said pair of bobbins from being broken down by whatever broke down the damaged one of said pair of bobbins. This safety feature is aimed toward the no-ground wire unit, since if the ground wire is eliminated, the electrical components of the machine will be protected from dead metal parts by the double insulation and barrier construction.

A further object of this invention is to provide in a stapling machine of the character described, an armature having a conical cavity at its lower end to receive but not to contact, a conical core fastened to the metal cup in which the coil is housed, to give extra power to the armature because of increased attraction surface, yet eliminating danger of destruction or damage to the machine by preventing the lower end of the armature from striking the core at each operation of the armature.

A still further object of this invention is to provide a strong, rugged and durable electro-magnetic stapling machine of the character described, which shall be relatively inexpensive to manufacture, sure and positive in operation, safe to use and yet practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 1:
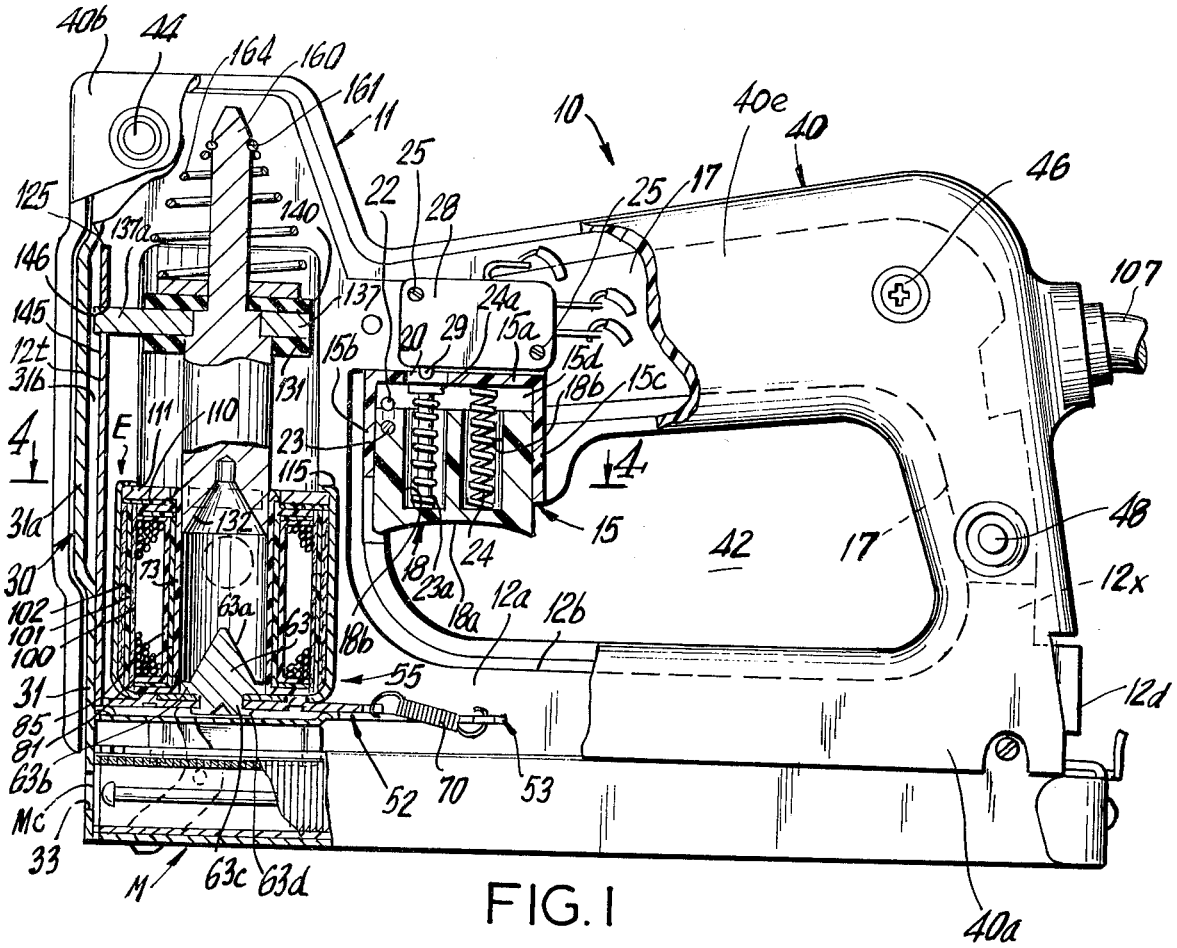
FIG. 1 is a side, elevational view of an electro-magnetic stapling machine embodying the invention, with parts brokenaway and in cross-section.

Referring now in detail to the drawing, 10 designates an electro-magnetic stapling machine embodying the invention. The machine 10 is generally like the electro-magnetic stapler of said U.S. Pat. No. 3,786,978 except for changes noted hereinafter in the means to prevent operation of the stapler unless the stapler is on a work-piece, in the construction of the bobbin for the electro-magnetic coil and in the armature controlled by said coil and a core fixed to the cup in which the coil is housed, which core cooperates with the armature, all as described in detail hereinafter.

The machine 10 comprises a metal body member 11 made of two symmetrical, substantially similar metal frame members 12.

Each member 12 comprises a horizontally extending lower wall portion 12*a* disposed in a vertical plane and having an upper horizontal edge 12*b*, and a lower horizontal edge 12*c*. At the forward end of each wall 12*a* is an outwardly and forwardly inclined wall 12*f* from which there extends forwardly, a downwardly and inwardly converging inclined wall 12*g*.

Each member 12 further comprises a vertical wall 12*h* disposed forwardly and above wall 12*f* and outwardly of the plane of wall 12*a*. Wall 12*h* extends upwardly and forwardly and comprises portions 12*h*1 and 12

Extending from each wall 12*h* is a part cylindrical wall 12*j* disposed between wall portions 12*h*1 and 12*h*2. The part cylindrical wall 12*j* is joined to wall 12*g* by a lower shoulder 12*k* and is joined to an upper wall 12*h*3 disposed above part cylindrical wall 12*j*, by a top shoulder 12*m*. Wall portion 12*h*2 is disposed forwardly of wall 12*j*; wall portion 12*h*3 is disposed above shoulder 12*m* and wall portion 12*h*1 is disposed rearwardly of wall 12*j*. Extending inwardly from the rear side of the upper end of part cylindrical wall 12*j* is a shoulder 12*u*, from which there extends rearwardly, a vertical flange 12*w* substantially in the plane of the wall 12*a*.

Wall portion 12*h* of each member 12 has upper and lower aligned vertical front edges 12*s* between which is an intermediate vertical edge 12*t* disposed somewhat rearwardly of said front edges.

Portions 12*h* of frame members 12 form part of a front head for the stapling machine. Disposed between the flanges 12*w* of members 12 is a trigger housing 15 made of plastic, open at its underside and having a horizontal wall 15*a* from which there extends downwardly, a front wall 15*b*, a rear wall 15*c* and side parallel walls 15*d*, forming a socket open at the bottom and in which a trigger member 18 is slidably mounted.

Trigger 18 projects below the trigger housing. Extending up from the horizontal wall 15*a* is a flange lying against the inner surface of the flange 12*w* of one member 12, as shown and described in said U.S. Pat. No. 3,786,978. A non-conducting plastic plate 17 disposed in a vertical plane, and in the shape of a handle, has one end located at and attached to the inner surface of flange 12*w* of the other frame member 12 and its other end contacts the inner surface of arm 12*x* of wall 12*a* of said other frame member 12 as described in said U.S. Pat. No. 3,786,978.

Between the forward end of said plate 17 and flange 15*f* of trigger housing 15, is a micro-switch 28 provided at its underside with a switch actuator button 29 projecting through a hole 20 in wall 15*a*.

Trigger 18 has limited sliding, up and down movement in the trigger housing socket. To this end, one wall 15*d* of the housing has a vertical slot 22 receiving a transverse pin 23 on the trigger. The lower end of the trigger is curved upwardly as at 18*a*. Said trigger has two upwardly opening bores 18*b* receiving compression springs 23*a*, 24 which bias the trigger downwardly to a non-operative position. One of the bores 18*b* is aligned with opening 20. A switch actuating member 24*a* rests on the spring 23 in the bore 18*b* which is aligned with the opening 20 and actuator button 29, to operate said button when the trigger is pulled up by the finger of the operator.

Figure 2:
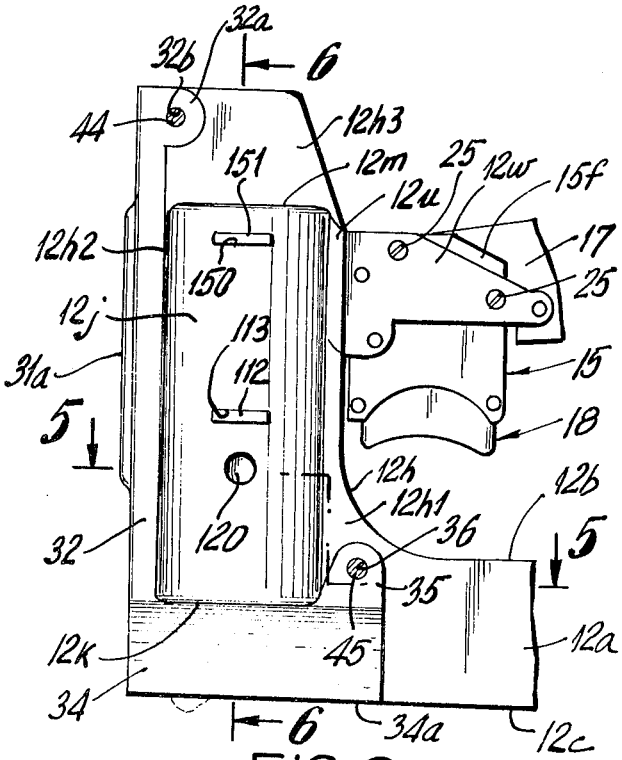
FIG. 2 is a partial, side elevational view of the machine, with the outer cover of the machine removed.
Figure 3:
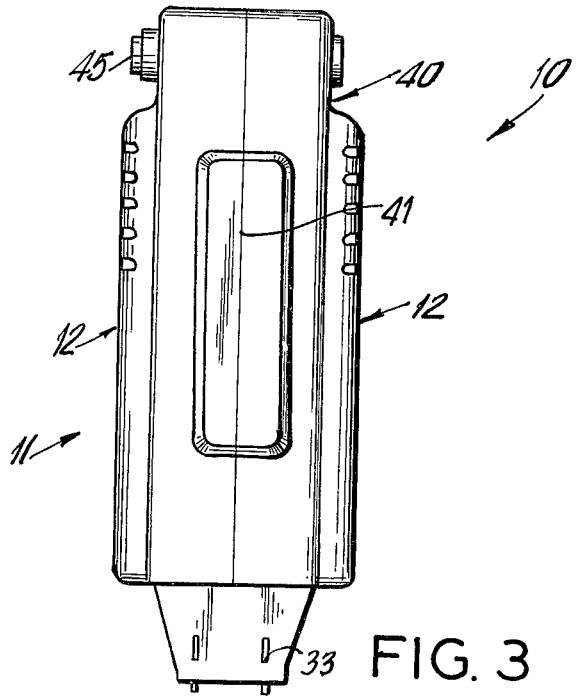
FIG. 3 is a front elevational view of the structure shown in FIG. 2.
Figure 4:
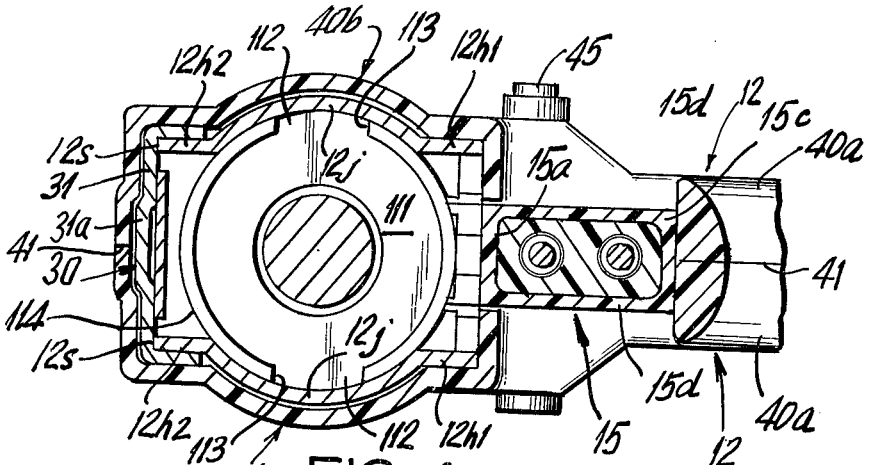
FIG. 4 is a cross-sectional view taken on line 4—4 of FIG. 1.

The plate 17 and micro switch 28 are fixed to flange 15*f*, and flanges 12*w* of member 12 by transverse screws 25 (FIGS. 1 and 2).

Figure 5:
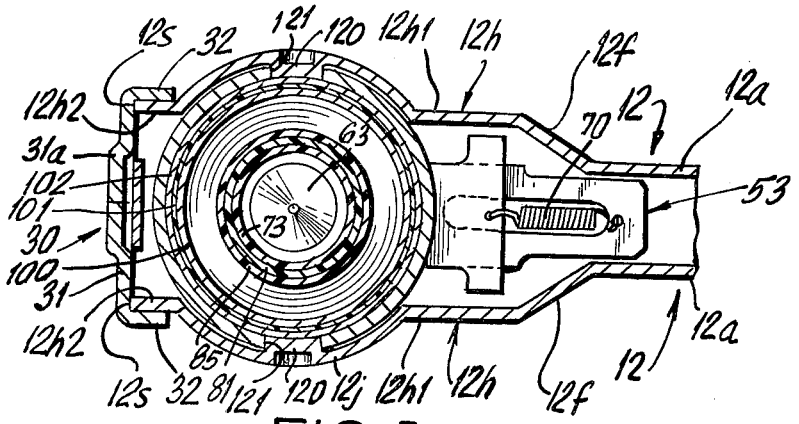
FIG. 5 is a cross-sectional view taken on line 5—5 of FIG. 2.
Figure 7:
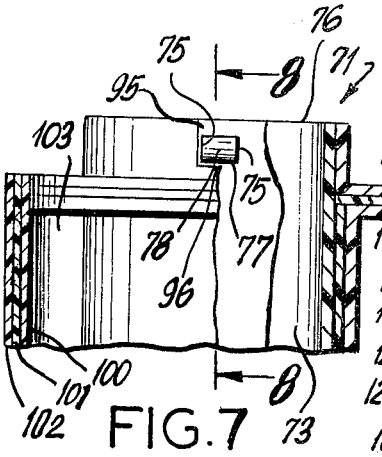
FIG. 7 is a partial, enlarged view of the bobbin assembly for the electro-magnetic coil.
Figure 6:
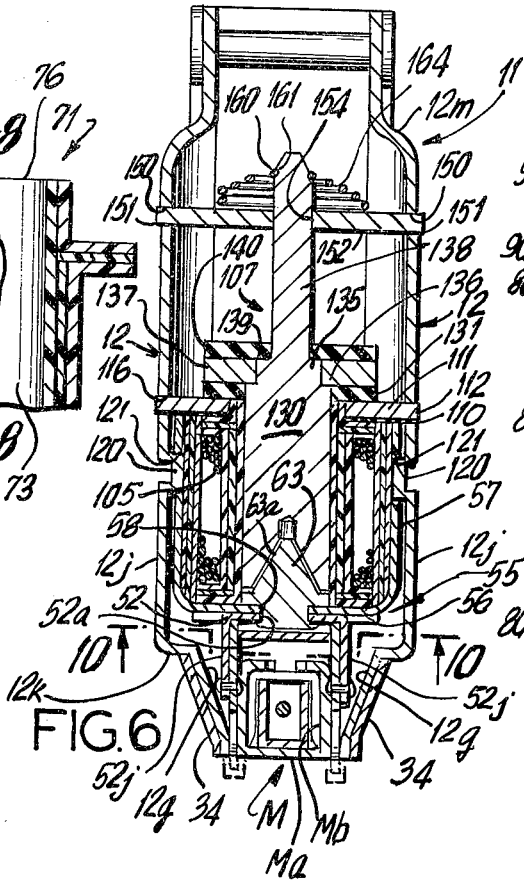
FIG. 6 is a cross-sectional view taken on line 6—6 of FIG. 2.
Figure 8:
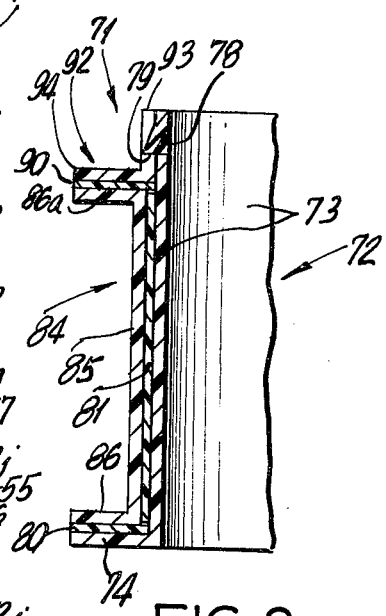
FIG. 8 is a cross-sectional view of the bobbin assembly on line 8—8 of FIG. 7.

Fitted over the front of frame 11 is a front metal cover member 30 (FIGS. 1 and 5). Said member 30 comprises a front wall 31 contacting front edges 12*s* of frame members 12. Extending rearwardly from the sides of front wall 31 are side flanges 32 contacting outer adjacent surfaces of portions 12*h*2 of frame members 12. Front wall 31 has two vertical slots 33 near its lower end to receive front ends of the side walls of a staple magazine as will be explained hereinafter. The lower ends of said side walls 32 are inclined downwardly and inwardly, as at 34, contacting the outer surfaces of walls 12*g* of frame members 12. Walls 34 extend rearwardly and have upstanding ears 35 formed with openings 36 registering with similar openings in walls 12*h*1 of frame members 12.

Front wall 31 of cover 30 has a forwardly recessed, central, vertical portion 31*a* terminating short of the upper and lower ends of said front wall and being substantially coextensive with edges 12*t* of frame members 12.

Surrounding the frame members 12 and the front cover 30 are a pair of similar, symmetrical heat and electricity insulating cover members 40 having meeting edges 41 along a central vertical plane. Said members 40 have lower horizontal portions 40*a*, front portions 40*b* and a handle portion 40*c* housing the plastic handle portion 17, so as to form a hand hole 42 into which the trigger 18 projects. The cover members 40 are fixed to each other and to the frame members 12, and the frame members are fixed to each other, by a transverse bolt or rod 44 passing through openings 32*b* in ears 32*a* of flanges 32, bolt or rod 45 passing through openings 36, and a bolt or rod 46 passing through a suitable hole (not shown) in plate 17 and through aligned openings in cover member 40. Arms 12*x* of frame members 12 are fixed to the rear lower end of plate 17 by a bolt 48 which also serves to aid in attaching cover members 40 together.

The structure described above is disclosed in said U.S. Pat. No. 3,786,978.

Mounted on and between walls 12*j* of said frame members 12 is a metal cup 55 having a bottom wall 56 from which a cylindrical wall 57 extends upwardly. Bottom wall 56 has a central hole 58. Contacting the underside of the bottom wall 56 of the cup 55 is a plate 52 having a hole 52*a* registering with said hole 58. Said plate 52 is fixed to said bottom wall by a metal core 63 having a conical upper end 63*a* from the base of which extends a flange 63*b* seated on the bottom wall. Extending down from the conical upper end of the core is a stem 63*c* passing through openings 58, 52*a* and riveted against the underside of the plate 52 as at 63*d*. Said plate 52 extends rearwardly of the cup 55 as at 52*b*. Said rear end 52*b* has wings 52*c* and is formed near its rear edge with a hole 52*d* for the purpose hereinafter appearing. Said plate 52 also projects forwardly of the cup 55 as at 52*c*, and said forward end has wings 52*f* and is formed with a central groove 52*g* for the purpose hereinafter appearing. Extending down from the sides of plate 52 are parallel, flanges 52*h* each having a vertical central portion 52*j* provided with a downwardly extending vertical ear 52*k*. Each flange 52*k* has inwardly recessed forwardly and rearwardly extending fingers 52*m* at its opposite ends. The upper edges of fingers 52*m* lie in a horizontal plane spaced below the underside of plate 52.

Slidably mounted between the upper edges of fingers 52*m* and the underside of plate 52 is a slider 53. Said slider 53 comprises a horizontal wall 53*a* slidably contacting the upper edges of fingers 52*m*, and disposed between the flanges 52*j*. Said wall 53*a* is formed at opposite edges thereof with grooves 53*b*. Extending up from the rear end of wall 53*a* is a shoulder 53*c* from which a horizontal flange 53*d* extends rearwardly in sliding contact with the underside of the rear end 52*b* of plate 52. Flange 53*d* projects rearwardly beyond wall 52*b* and is formed with a central elongated slot 53*e* and with a small central opening 53*f* aligned with opening 52*d*. A coil tension spring 70 has hooked ends engaging openings 52*d*, 53*f* to bias the slider 53 forwardly. At its forward end wall 53*c* has a central tongue 53*g* normally located beneath the groove 52*g*, and a pair of upwardly bent fingers 53*h* slidably contacting the underside of fixed plate 52. The upwardly bent shoulders 53*c* and fingers 53*h* keep wall 53*e* in horizontal position, parallel to wall 53*a*.

Figure 9:
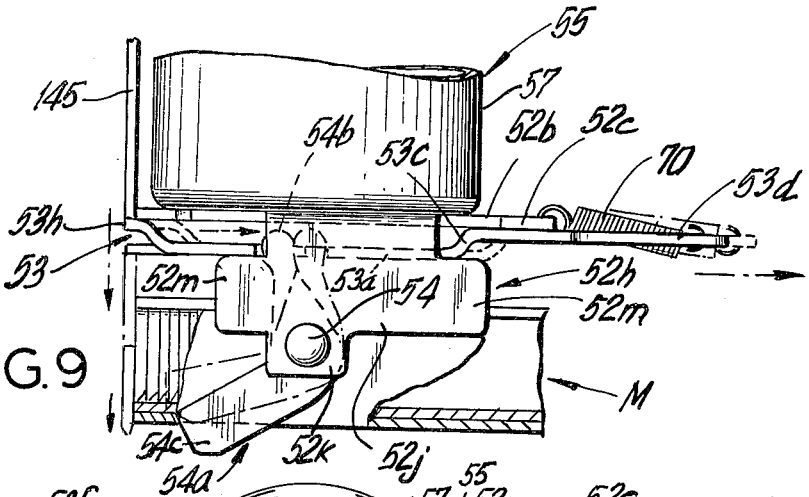
FIG. 9 is a side elevational view of the work piece engaging mechanism and the blocking mechanism for the staple driving plunger, controlled thereby.
Figure 10:
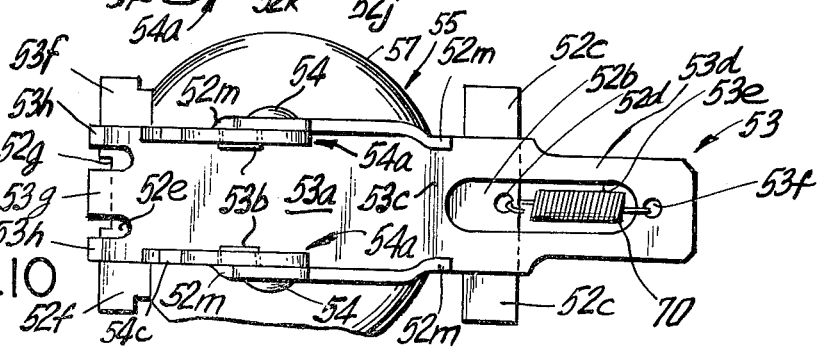
FIG. 10 is a cross-sectional view taken on line 10—10 of FIG. 6, but omitting the casing which houses the coil cup.

Pivoted to the ears 52*k* by rivets 54 are bell cranks 54*a* disposed in vertical planes and contacting the inner surfaces of flanges 52*j* and ears 52*k*. Each bell crank 54*a* has an upwardly extending arm 54*b*, the upper end of which is received in groove 53*b* in wall 53*a*, and a downwardly and forwardly inclined arm 54*c* normally projecting below the lower edge 34*a* of wall 34 (FIGS. 9 and 10). In normal position, when the machine 10 is not on a work piece, spring 70 has pulled member 53 forwardly to the full line position of FIGS. 9 and 10, and turned the bell cranks 54*a* in counterclockwise directions to the full line positions of said figures, due to engagement of the rear ends of grooves 53*b* with the upper ends of arms 54*b* of said bell cranks. In such position, the tongue 53*g* of plate 53 underlaps the groove 52*g* for the purpose herein after appearing. In such position furthermore, the lower ends of arms 54 *c* are below the staple magazine M.

Said staple magazine may be of the construction disclosed in said U.S. Pat. No. 3,786,978 and lies between the side walls 12*a* with the underside of the magazine in the plane of the lower edges 12*c* of walls 12*a*. Said stable magazine comprises a magazine housing M*a* having side walls M*b* disposed inside of bell cranks 54*a*. Said side walls M*b* have lugs M*c* at their front ends received in slots 33. The staple magazine need not be fully described as it is constructed as shown and described in said U.S. Pat. No. 3,786,978.

When the machine 10 is placed on a work piece, bell cranks 54*a* are rotated in a clockwise direction to slide the slider 53 rearwardly to the dot-dash position of FIG. 9, thus uncovering groove 52*g* and tensioning spring 70.

Referring now to the electro-magnet E of which the cup 55 is a part, 71 designates a bobbin assembly for an electromagnetic coil 105, housed in the cup. Said bobbin assembly comprises an inner central bobbin element 72 made of a high heat resistant, electricity insulating material such as glass filled nylon or other such suitable material. Said element 72 comprises an inner axial tubular portion 73 formed at its lower end with a horizontal, annular, outwardly extending integral flange 74. Just below its upper end, tubular portion 73 is formed at each of diametrically disposed sides thereof, with parallel vertical coextensive slits 75 terminating below the upper edge 76 of said tubular portion, and with a horizontal slit 77 joining the slits 75, thereby providing a flap 78 which can be pushed outwardly to present a lower edge 79 for the purpose hereinafter appearing.

On top of flange 74 is an annular disc 80 of any suitable material such as nylon, metal or any other suitable material, for the purpose hereinafter explained. Wrapped around the tubular protion 73 is a sheet 81 of nylon, metal or other suitable material. The sheet 80 is overlapped at its ends to extend all around tubular portion 73. A tube can replace the wrap around sheet 81. The sheet 81 extends from disc 80 to a level below the flaps 79. Fitted over the wrap around sheet 81 is a bobbin element 84 comprising tubular portion 85 provided with an integral outwardly extending annular lower flange 86 resting on disc 80 and an integral, outwardly extending upper annular flange 86*a* at its upper end at the level of the upper end of the wrap around sheet 81. Said bobbin element 84 is also made of high heat resisting, electricity insulating material such as nylon or any other suitable material.

Fitted on the tubular portion 73 and resting on flange 86*a* is an annular disc 90 of nylon, metal or any other suitable material. Thus discs 80 and 90 are at the lower and upper ends, respectively, of the wrap around sheet 81.

Mounted on the upper end of tubular portion 73 is a bobbin element 92 comprising a tubular portion 93, telescoped on tubular portion 73, and from the lower end of said tubular portion 93, there extends outwardly an annular flange 94 resting on disc 90. Said element 92 is made of high heat resisting, electricity insulating material such as nylon or any other suitable material. The upper end of tubular portions 73, 93 are at the same level. Said tubular portion 93 is formed, at diametrically opposed locations with notches 95 to receive the lower ends of flaps 78 so that the lower edges 77 of said flaps will engage the lower edges 96 of said notches to retain the element 92 on the disc 90.

Disposed about the outer edges of flanges 86, 86*a*, discs 80, 90 and flanges 74, 94 is a tube 100 of fiber glass, nylon, or any other suitable high heat resisting, electricity insulating material. Disposed about said tube 100 is a tube 101 coextensive therewith and made of nylon, metal or any other suitable material. Disposed about tube 101 and coextensive therewith is a tube 102 of any suitable high heat resisting, electricity insulating material such as fiber glass, nylon or the like. In the tubular chamber 103 bounded by tube 85, flanges 86, 86*a* and tube 100 is an electro-magnetic coil 105 to energize an armature 107. Said coil 105 is electrically connected to a trigger control circuit such as shown in FIG. 9 of said U.S. Pat. No. 3,786,978 except that the switch 300 of said patent is omitted, wires 205*a* and 205 of said circuit being connected. The coil 105 herein, corresponds to the coil 130 of said patent and the elements of said circuit are mounted on plastic handle shaped plate 17 herein and the wires corresponding to wires 184, 196 of said circuit pass out of the machine by cable 107 shown in FIG. 1. The wall 57 of cup 55 herein and the bobbin assembly may be suitably notched to allow the terminal wires of the coil to pass out of the cup. These terminal wires correspond to wires 182, 192 of the circuit of FIG. 9 of said U.S. Pat. No. 3,786,978.

It will now be understood that the bobbin assembly 70 herein comprises inner and outer bobbins of high heat resisting, electricity insulating material and a barrier bobbin between said inner and outer bobbins. The barrier bobbin keeps whatever breaks down one of the pair of inner and outer bobbins from breaking down the other of said pair of bobbins. While the barrier bobbin can comprise a tube instead of a wrap around sheet, the advantage of the wraparound sheet is to get a fit to conform to the inner tube 73. This bobbin assembly becomes a double insulating, high heat resisting bobbin with a barrier bobbin in between. This construction incorporates a safety feature, and is aimed at a no ground wiring unit. If the ground is eliminated, the electrical components are protected from dead material parts by this construction.

A layer or annular disc 110 of rubber or other resilient material can be placed over the flange 94 and the upper edges of tubes 100, 101, 102, and surrounding the tubular portion 93 of element 92. A metal plate 111 is placed on the disc 110 said disc 110 also surrounds tubular portion 93 and has outwardly projecting lugs 112 projecting through diametrically opposed notches 113 in the upper end of the cylindrical wall 57 of the cup 55. Said disc 111 has a pair of somewhat less than 180° part circular outer edges 114 located at the inner surface of cup wall 57. The upper end of wall 57 extends above the edges 114 of the disc 111 and is crimped over the upper surface of said disc to hold the disc tightly down on the bobbin assembly, as at 115. The lugs 112 project through slots 116 in the portions 12j of the frame members 12. Said slots 116 are located at the sides of the head of the stapling machine. In addition, said cup 55 is firmly located and held fixed relative to the attached together frame members 12 by inwardly extending round depressions 120 snugly received in round holes 121 in the cup wall 57. Holes 121 are diametrically opposed and located below the slots 113. The armature 107 comprises a lower cylindrical portion 130 slidably received in tube 73. A compressible shock absorbing annular disc 131 surrounds the upper end of said cylindrical portion 130. At the lower end of said cylindrical portion 130 is a cavity 132 of conical shape adapted to receive the conical core 63*a*. When the armature is pulled down upon energizing of the coil 105, the inner conical surface of the cavity 132 is slightly spaced above the core 63 so that the armature does not strike the core.

Said armature, above the cylindrical rod portion 130 has a reduced coaxial portion 135 forming an upwardly facing shoulder 136. On said shoulder 136 is a metal disc 137. Above reduced portion 135 is a further diametrically reduced coaxial rod 138 forming another upwardly facing shoulder 139. Surrounding said rod 138 and seated in said shoulder 139 and on said disc 137 is another resilient pad 140. Pads 131, 140 and disc 137 are fixed to the armature 107 and move up and down therewith. When the armature 107 is pulled down upon energizing the coil 105, disc 131 strikes the metal plate 111 to stop the downward movement of the armature.

Disc 137 has a forwardly extending arm 137*a* projecting into the space 31*b* formed by the recessed portion 31*a*. Mounted on the forward end of said arm 137*a* is a staple driving plunger 145 having a slot 146 near its upper end to receive said arm. The plunger 145 passes through slot 52*g* of member 52 and will drive a staple when the machine is placed on the work piece and the trigger is pulled to energize the electro-magnetic coil. When the machine is not on a work piece and the slider 53 is not retracted, tongue 53*g* prevents the plunger 145 from driving a staple. Thus the slider 53 acts as a safety feature to avoid shooting out a staple when the machine is not in use, should the trigger be pulled accidentally or otherwise while the machine is not on a work piece. However, when the machine is on a work piece, the slider is mechanically retracted and pulling of the trigger will expell or drive a staple because in such case the slider is retracted.

The increased surface of the conical core and conical cavity of the armature gives increased power because such construction provides increased surface for magnetic attraction. Means is provided for limited upward movement of the armature 107 when the coil 105 is deenergized. To this end frame member portions 12*j* are formed with slots 150 to receive lugs 151 of a horizontal metal disc 152. The slots 150 are located directly above slots 113 below the shoulders 12*m*. Disc 152 is formed with a central opening 154 through which rod 138 passes upwardly. Near the upper end of rod 138 is an annular collar 160 in the form of a ring in an annular groove 161 in the rod. A tapered coil compression spring 164 is interposed between the disc 152 and the ring or collar 160. The lower portion of the spring is of largest diameter. Said spring moves the armature up when the coil is deenergized and is compressed when the coil is energized. The pads 131 and 140 act as shock absorbers.

It will thus be seen that there is provided an article in which the several objects of this invention are achieved, and which is well adapted to meet the conditions of practical use.

As possible embodiments might be made of the above invention, and as various changes might be made in the embodiments above set forth, it is to be understood that all matter herein set forth or shown in the accompanying drawings, is to be interpreted as illustrative only.

I claim:

1. An electro-magnet comprising a bobbin assembly, said assembly comprising first and second nested bobbins made of high heat resisting, electricity insulating material and comprising central axial inner tubular portions and spaced upper and lower flanges extending outwardly from said axial inner tubular portions, and outer tubular portions at the outer ends of said flanges, and a barrier bobbin interposed and nested between said first and second bobbins and comprising an axial tubular portion disposed between the axial inner tubular portions of said first and second bobbins, a flange between the upper flanges of said first and second bobbins, a flange between the lower flanges of said first and second bobbins, and an outer tubular portion disposed between the outer tubular portions of said first and second bobbins, and said bobbin assembly forming an annular chamber bounded by said inner tubular portions, said outer tubular portions and said upper and lower flanges, and a coil of conductive wire within said chamber.

2. The combination of claim 1, said barrier bobbin being made of high heat resisting, electricity insulating material.

3. The combination of claim 1, a casing receiving said bobbin assembly, having a bottom wall, a core fixed to the bottom wall of said casing and projecting up into the tubular hole formed by the innermost tubular portion of said first and second bobbins, an armature slidable in said tubular hole and having a cavity to receive part of said core.

4. The combination of claim 3, said core having an upwardly pointed conical portion, and said cavity being of conical shape complementary to said conical portion of said core.

5. The combination of claim 4, and means to prevent said armature from striking said core.

6. The combination of claim 1, said inner tubular portion of said first bobbin extending above the upper flange of said first bobbin, and having releasable means to retain the upper flange of said first bobbin on the upper flange of said barrier bobbin.

7. The combination of claim 6, said releasable means comprising a tubular portion integral with said upper flange of said first bobbin and extending upwardly therefrom and formed with a notch, and an upper end portion on said tubular portion of said first bobbin, projecting above said upper flange of said first bobbin and formed with a tab movable into said notch to engage the lower edge of said notch.

8. The combination of claim 1, said inner tubular portion of said barrier bobbin comprising a wrap around sheet having overlapping portions.

9. An electro-magnet comprising a bobbin assembly, said assembly comprising first and second nested interfitted, but unadhered together bobbins made of high heat resisting, electricity insulating material and comprising central axial inner tubular portions and spaced upper and lower flanges extending outwardly from said axial inner tubular portions, and outer tubular portions at the outer ends of said flanges, and a barrier bobbin interposed and nested between said first and second bobbins and unadhered to and removable from said first and second bobbins, and comprising an axial tubular portion disposed and fitted between the axial inner tubular portions of said first and second bobbins, a flange between the upper flanges of said first and second bobbins, a flange between the lower flanges of said first and second bobbins, and an outer tubular portion disposed between the outer tubular portions of said first and second bobbins, and said bobbin assembly forming an annular chamber bounded by said inner tubular portions, said outer tubular portions and said upper and lower flanges, and a coil of conductive wire within said chamber, and a metal casing receiving said bobbin assembly and comprising an outer casing wall surrounding said bobbin assembly.

10. The combination of claim 1, and a metal casing receiving said bobbin assembly and having an outer casing, a bottom wall and a core fixed to the bottom wall of the casing and projecting up into the tubular hole formed by the innermost tubular portion of the first and second bobbins, and an armature slidable in said tubular hole.

11. The combination of claim 10, and means to prevent said armature from striking the core.

* * * * *